US008356461B2

(12) United States Patent
Cedrone

(10) Patent No.: US 8,356,461 B2
(45) Date of Patent: Jan. 22, 2013

(54) APPARATUS FOR CLEANING, FILLING, AND SEALING A CONTAINER

(75) Inventor: Daniel Pompei Cedrone, Huntersville, NC (US)

(73) Assignee: H2Local, Inc., Huntersville, NC (US)

( * ) Notice: Subject to any disclaimer, the term of this patent is extended or adjusted under 35 U.S.C. 154(b) by 501 days.

(21) Appl. No.: 12/618,193

(22) Filed: Nov. 13, 2009

(65) Prior Publication Data

US 2010/0050574 A1 Mar. 4, 2010

Related U.S. Application Data

(63) Continuation-in-part of application No. 12/390,098, filed on Feb. 20, 2009, now Pat. No. 7,980,046.

(60) Provisional application No. 61/066,439, filed on Feb. 20, 2008.

(51) Int. Cl.
*B65B 55/24* (2006.01)

(52) U.S. Cl. ..... 53/484; 53/284.5; 53/284.6; 53/467

(58) Field of Classification Search ..... 53/167, 53/48.1, 48.5, 48.7, 425, 473, 484–485, 79, 53/284.5, 284.6, 426
See application file for complete search history.

(56) References Cited

U.S. PATENT DOCUMENTS

| | | | | |
|---|---|---|---|---|
| 2,681,872 | A | 6/1954 | McCabe | |
| 3,393,491 | A | 7/1968 | Burton et al. | |
| 4,573,505 | A | 3/1986 | Lee et al. | |
| 4,862,933 | A * | 9/1989 | Gies | 141/130 |
| 5,115,617 | A * | 5/1992 | Lewis et al. | 53/306 |
| 5,425,402 | A | 6/1995 | Pringle | |
| 5,441,063 | A | 8/1995 | Fernandez et al. | |
| 6,341,630 | B2 * | 1/2002 | Reinecke | 141/168 |
| 6,343,628 | B2 | 2/2002 | Reinecke | |
| 6,516,939 | B1 * | 2/2003 | Schmidt et al. | 198/458 |
| 6,684,602 | B2 | 2/2004 | Reinecke | |
| 6,991,002 | B2 * | 1/2006 | Osborne et al. | 141/27 |
| 7,114,535 | B2 * | 10/2006 | Hartness et al. | 141/145 |
| 7,162,849 | B2 | 1/2007 | Bernhard | |
| 7,216,758 | B2 * | 5/2007 | Hartness et al. | 198/803.7 |
| 7,278,531 | B2 * | 10/2007 | Hartness et al. | 198/470.1 |
| 7,299,607 | B2 | 11/2007 | Clusserath et al. | |
| 7,392,632 | B2 | 7/2008 | Wiedemann et al. | |
| 2009/0205746 | A1 | 8/2009 | Yousefpour et al. | |

OTHER PUBLICATIONS

International Search Report and Written Opinion mailed May 3, 2010.

* cited by examiner

*Primary Examiner* — Christopher Harmon
(74) *Attorney, Agent, or Firm* — Summa, Additon & Ashe, P.A.

(57) ABSTRACT

An apparatus for washing, filling, and sealing a container includes an enclosure having an opening for receiving a container. The apparatus may include a rotary assembly, a wash station, a rinse station, a fill station, and a seal station all contained within the enclosure. The rotary assembly may include any number of racks for carrying the containers. The rotary assembly advances (e.g., about an axis) and facilitates the washing, filling, and sealing of the containers within the enclosure. The apparatus may be employed in a method for washing, rinsing, filling, and sealing containers within an enclosure. The method may be conducted consecutively. The steps of washing, filling, and sealing are conducted simultaneously.

12 Claims, 11 Drawing Sheets

APPARATUS FOR CLEANING, FILLING, AND SEALING A CONTAINER

CROSS-REFERENCE TO PRIORITY APPLICATION

This application is a continuation-in-part of and claims the benefit of the Provisional Patent Application Ser. No. 61/066,439 (filed Feb. 20, 2008), and Non-Provisional patent application Ser. No. 12/390,098 (filed Feb. 20, 2009) now U.S. Pat. No. 7,980,046, both of which are hereby incorporated by reference in their entirety.

FIELD OF THE INVENTION

The invention relates to an apparatus and method for cleaning, filling, and sealing one or more containers.

BACKGROUND

Consumable liquids (e.g., water, soda, and juice) are commonly packaged in individual containers such as glass or plastic bottles. The bottling of such containers typically takes place on a large industrial scale. For example, a large conveyor advances containers through various stages of the bottling process (e.g., filling and capping the bottles).

Although suitable for large-scale production of filled containers, such bottling machinery is not suitable for local, small-scale production of filled containers at locations such as restaurants, cafeterias, businesses, and resorts. For example, such bottling machinery requires a large space. Moreover, acquiring such bottling machinery requires significant initial capital outlays and operating the machinery is expensive.

Accordingly, a need exists for an apparatus for filling a container that takes up minimal space and is suitable for small-scale production of filled containers. Such an apparatus would also have the added advantage of being readily transportable to various locations. A need also exists for an apparatus that is relatively inexpensive. It is also desirable to minimize the number of containers discarded in landfills. Furthermore, it is desirable to have an apparatus capable of cleaning used containers (e.g., sanitizing) such that the containers can be filled, sealed, and reused. It is also desirable to promote the recycling efforts of individuals and institutions.

SUMMARY OF THE INVENTION

In one embodiment, the present invention embraces a novel apparatus for filling a container with, for example, a liquid. The apparatus includes an enclosure, a shuttle assembly housed by the enclosure, and a frame structure defined by the shuttle assembly. The enclosure has one or more (i.e., at least one) openings for receiving a container or containers. The shuttle assembly is configured to receive the container. In operation, the shuttle assembly advances along a path of travel (i.e., reciprocal or rotational) and facilitates the cleaning, filling, and sealing of the container. It will be understood that the term "cleaning" refers to the act of rinsing (i.e., to cleanse by flushing with a liquid) or sanitizing (i.e., to make sanitary by cleaning) a container.

In another embodiment, the present invention provides a novel apparatus for cleaning, filling, and capping a container. The apparatus includes an enclosure and a shuttle assembly having a rotatable shuttle secured within the enclosure. A wash station for cleaning the container, a rinse station for rinsing the container, a fill station for dispensing liquid into the container, and a seal station for capping the container are also housed by the enclosure (i.e., within the enclosure). Accordingly, each of the work stations are all housed within a single unit or enclosure. The shuttle assembly moves or rotates between the wash, fill, and seal stations along a path of travel and facilitates the cleaning, filling, and sealing of the container.

In another aspect, the present invention embraces a method for consecutively cleaning, filling, and sealing the containers within an enclosed housing. The method includes the steps of providing at least one container, cleaning the container, filling the container, and sealing the container. In operation, the method is conducted along a path of travel within the enclosure.

BRIEF DESCRIPTION OF THE DRAWINGS

The foregoing and other objects and advantages of the invention and the manner in which the same are accomplished will become clearer based on the following detailed description taken in conjunction with the accompanying drawings in which.

DETAILED DESCRIPTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
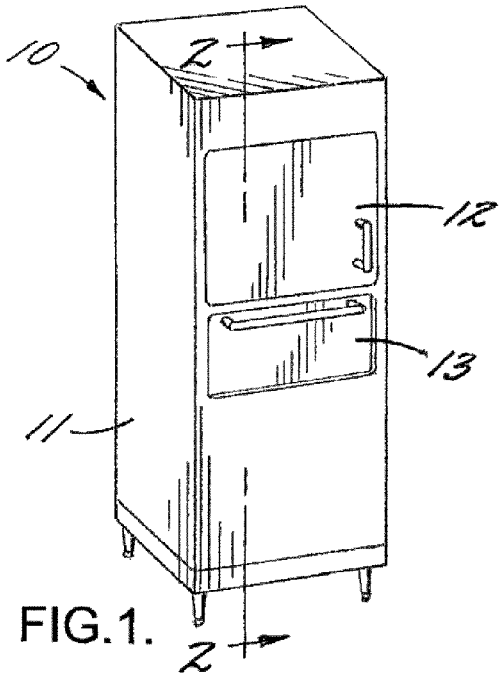
FIG. 1 is a perspective view of an apparatus for cleaning, filling, and sealing a container according to one aspect of the present invention.

In one aspect, the present invention embraces an apparatus for filling a container. FIG. 1 depicts an exemplary apparatus 10 for filling a container 14. The container 14 may be any suitable container (e.g., a glass bottle) capable of holding a liquid. The apparatus 10 includes an enclosure 11, a shuttle assembly 15, a shuttle 22, and a drive assembly 28. The enclosure 11 has at least one opening for receiving at least one container 14. For example, FIG. 1 depicts a shuttle assembly door 13, which may receive one or more containers 14. In one embodiment, the enclosure 11 may also include an opening for providing ready access to a seal station 16 housed within the enclosure 11. By way of example, the enclosure 11 may have a seal station door 12.

Figure 2:
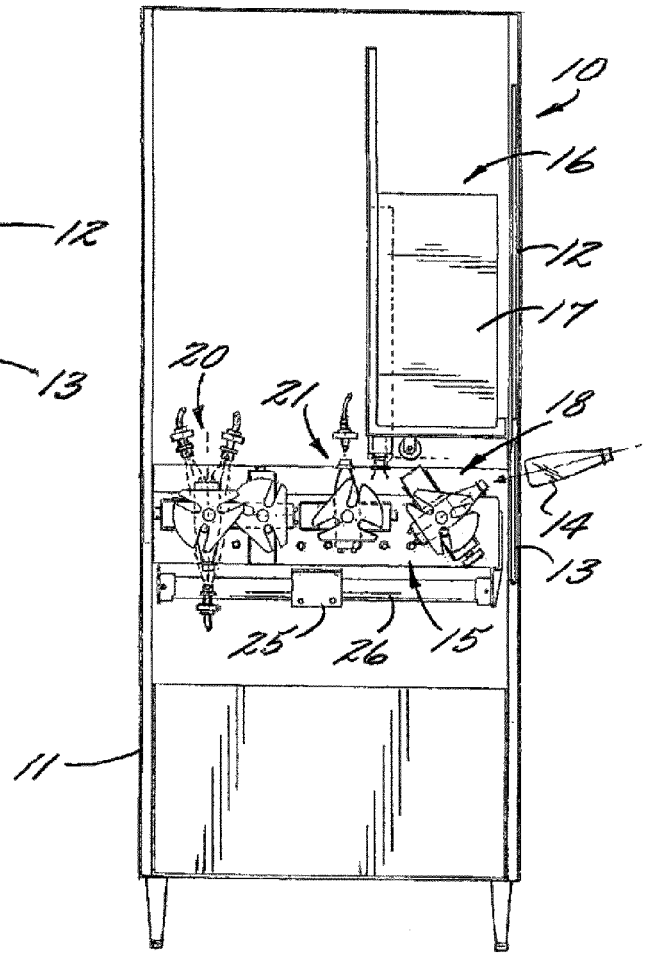
FIG. 2 is a cross-sectional side view of an apparatus for cleaning, filling, and sealing a container taken along line 2-2 of FIG. 1 according to one aspect of the present invention.
Figure 3:
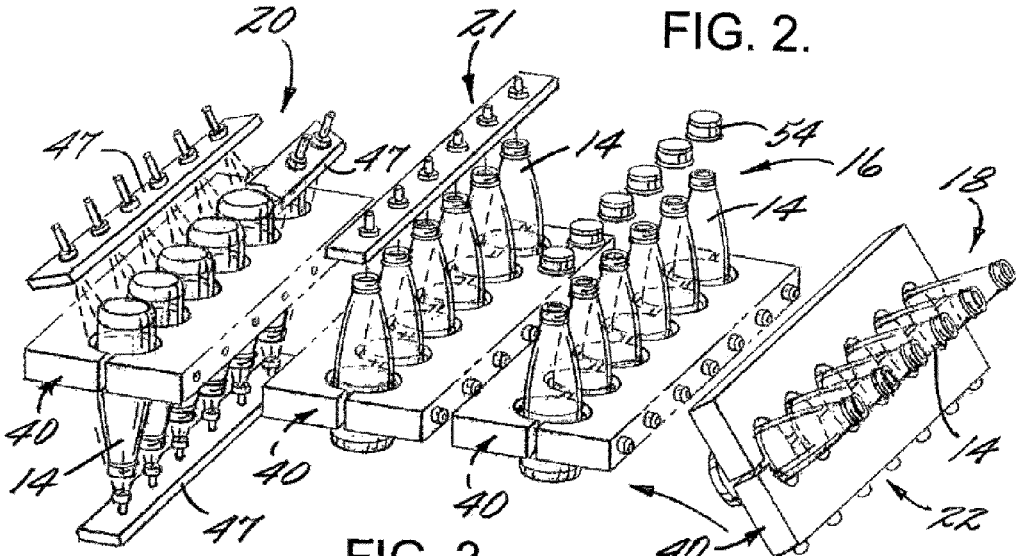
FIG. 3 is a perspective view of a shuttle in various positions according to one aspect of the present invention.
Figure 4:
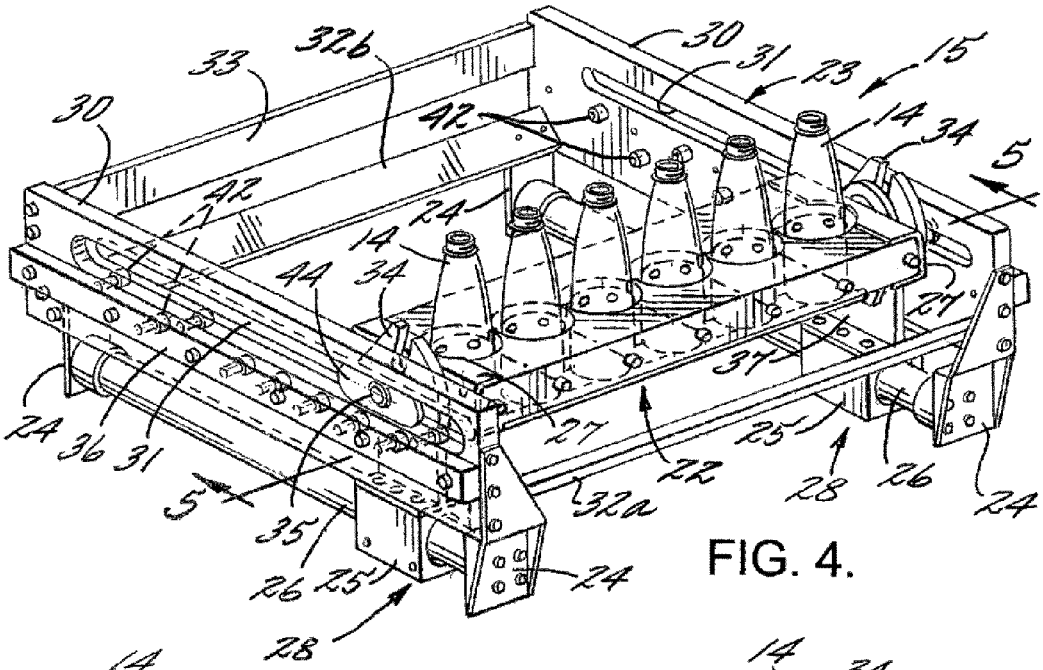
FIG. 4 is a perspective view of a shuttle assembly according to one aspect of the present invention.
Figure 5:
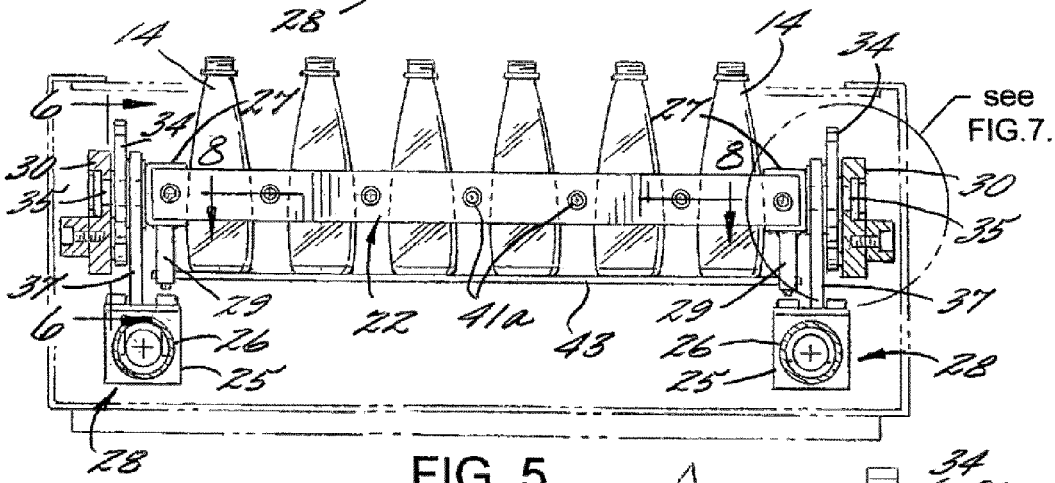
FIG. 5 is a longitudinal sectional view of a shuttle assembly taken along line 5-5 of FIG. 4 according to one aspect of the present invention.
Figure 6:
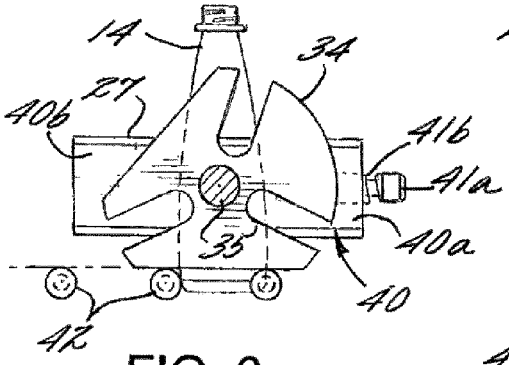
FIG. 6 is a transverse sectional view of the shuttle assembly taken along line 6-6 of FIG. 5 according to one aspect of the present invention.
Figure 7:
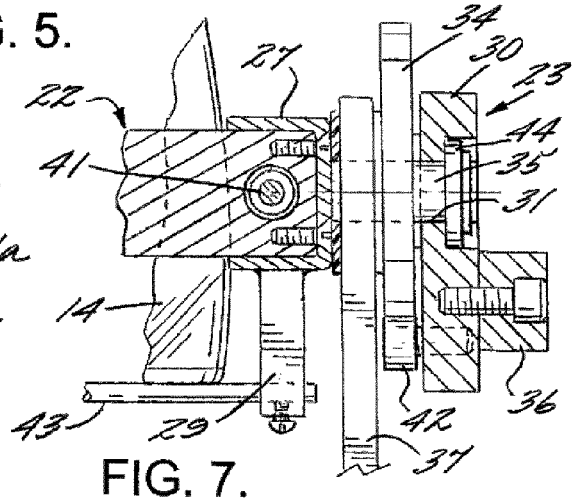
FIG. 7 is an enlarged partial longitudinal view of the shuttle assembly taken from FIG. 5 according to one aspect of the present invention.

FIG. 2 depicts a cross-sectional view of the apparatus 10. The shuttle assembly 15 is configured to receive a container 14 and is housed by the enclosure 11. In operation, a portion of the shuttle assembly 15 advances along a travel path and facilitates the cleaning, filling, and sealing of the container 14. For example, a portion of the shuttle assembly 15 (as discussed below) may reciprocate between a load/unload station 18, a wash station 20, a fill station 21, and a seal station 16.

FIGS. 4-8 depict the shuttle assembly 15 in more detail. The shuttle assembly 15 may include a shuttle 22 for carrying the container 14 along the travel path (e.g., the path the shuttle travels to facilitate the loading, cleaning, filling, and sealing of the container 14). Those of ordinary skill in the art will appreciate that the shuttle 22 may be suitable for carrying more than one container (e.g., 6 or 10 containers). Although the travel path is illustrated as extending horizontally with respect to the surface on which the enclosure 11 rests, it will also be understood that the travel path may extend vertically or any number of multiple directions (e.g., about an axis) suitable for facilitating the loading, cleaning, filling, and sealing (as well as unloading) of the container 14.

Figure 8:
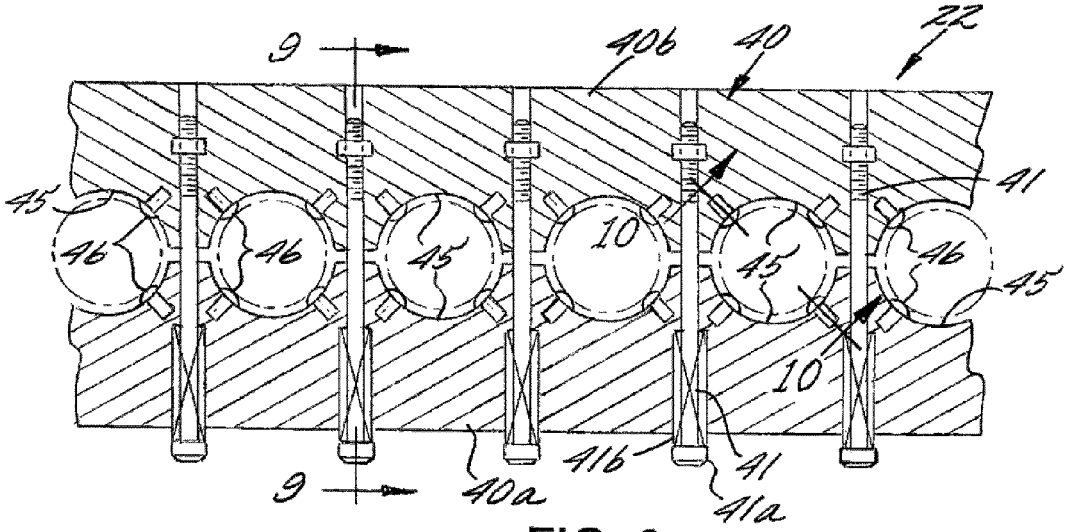
FIG. 8 is a partial top plan view of the shuttle and racks taken along line 8-8 of FIG. 5 according to one aspect of the present invention.

As illustrated in FIG. 8, the shuttle 22 defines at least one opening 45 for receiving and securing the container 14. The opening 45 may have a variable diameter for receiving containers of various shapes and sizes. For example, moveable projections 46 positioned about the periphery of the opening 45 may be used to secure the container 14. By way of further example, moveable projections 46 (i.e., gripper projections) may be adjustable clamping members (e.g., clamping buttons) employed to secure the container 14. It will be understood that the projections or buttons may be moved or actuated (e.g., reciprocated) by any number of drive means to include air, liquid, or mechanical means.

Figure 9:
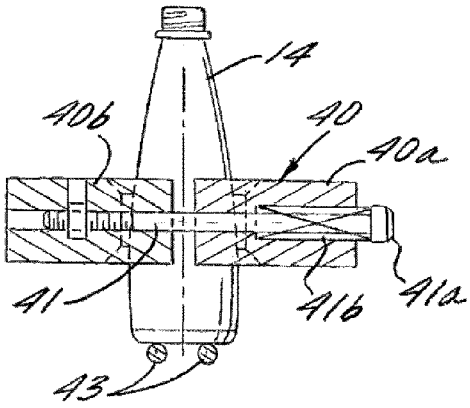
FIG. 9 is a cross-sectional side view of the rack in a second position taken along line 9-9 of FIG. 8 according to one aspect of the present invention.
Figure 9A:
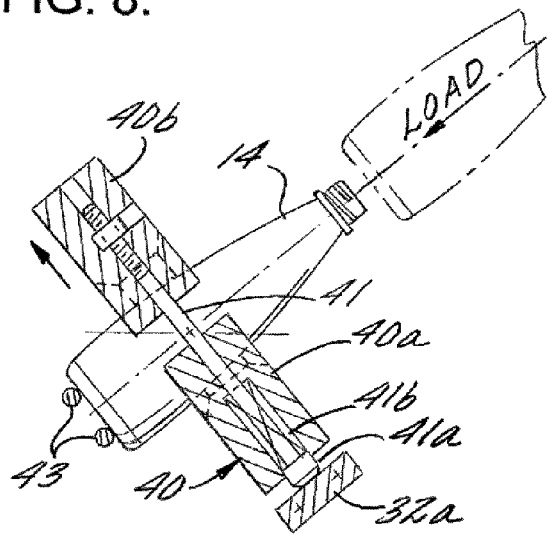
FIG. 9A is a cross-sectional side view of the rack in a first position taken along line 9-9 of FIG. 8 according to one aspect of the present invention.
Figure 10:
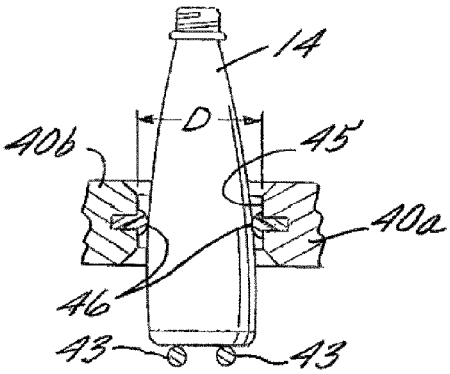
FIG. 10 is a partial cross-sectional oblique view of the rack taken along line 10-10 of FIG. 8 according to one aspect of the present invention.
Figure 10A:
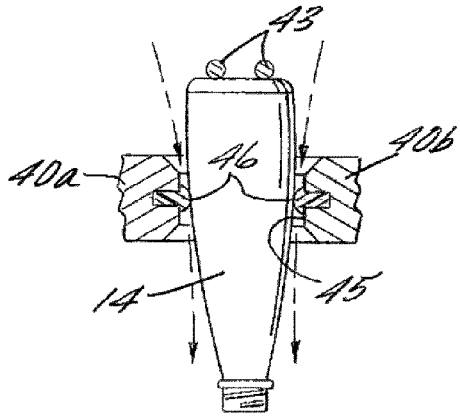
FIG. 10A is a partial cross-sectional oblique view of a rack in a third position taken along line 10-10 of FIG. 8 according to one aspect of the present invention.
Figure 11:
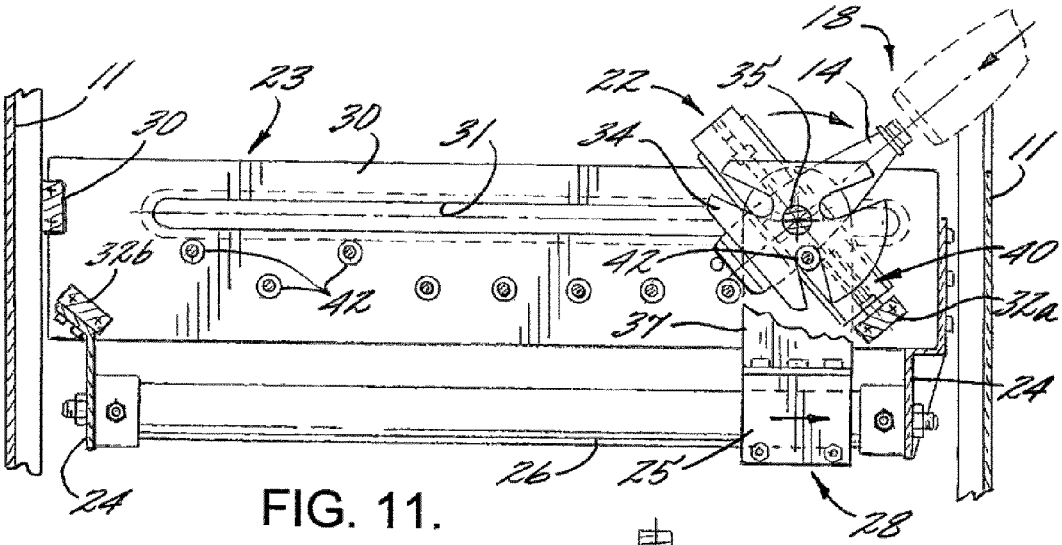
FIGS. 11-11E depict various steps of a method for cleaning, filling, and sealing a container a container according to one aspect of the present invention.
Figure 11A:
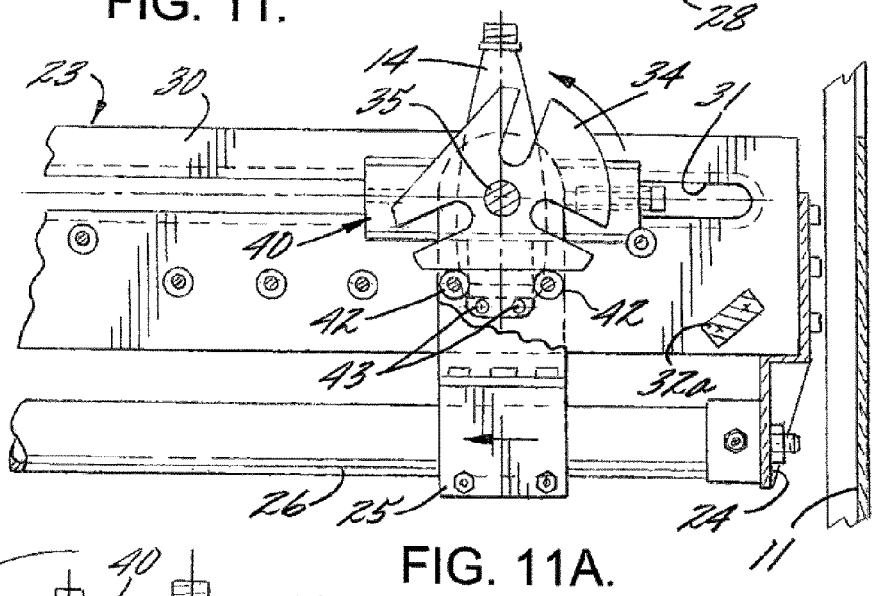
Figure 11B:
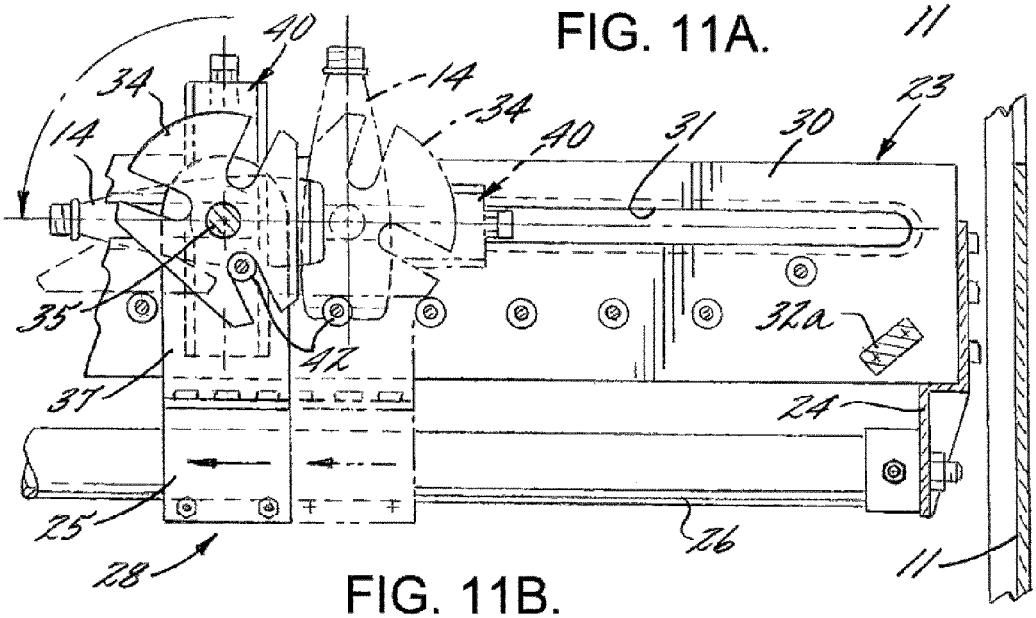
Figure 11C:
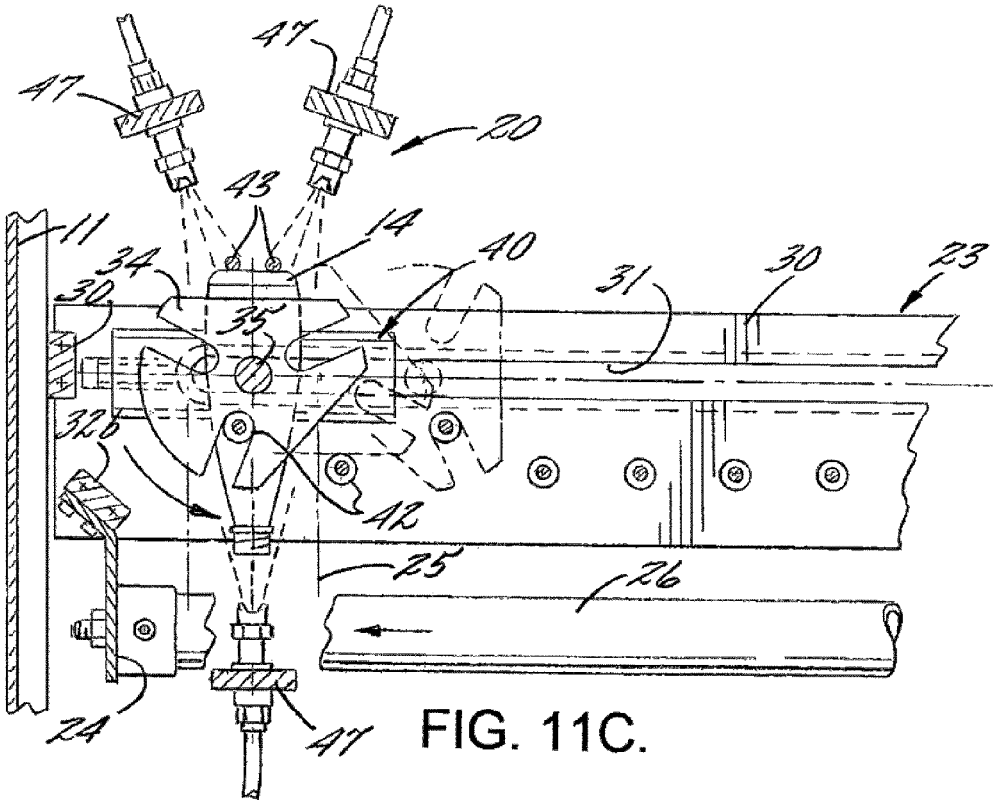
Figure 11D:
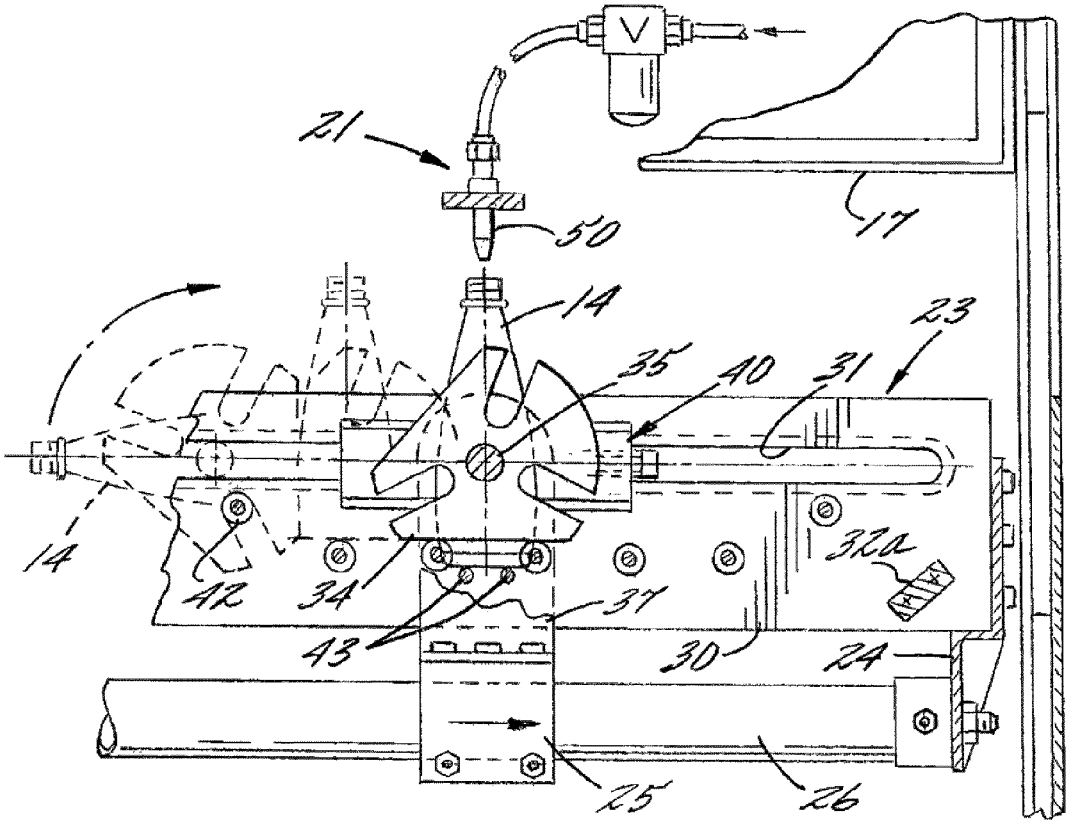
Figure 11E:
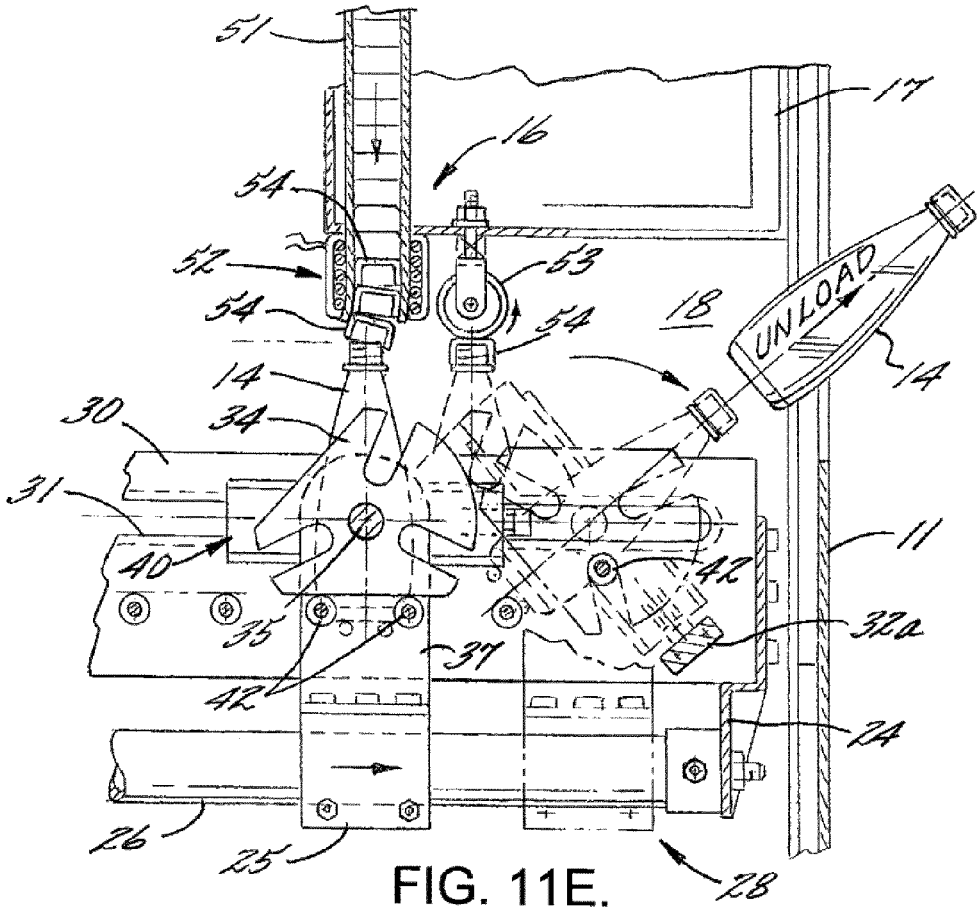

As depicted in FIG. 8, the shuttle 22 may include at least one rack 40 for receiving and securing the container 14. Accordingly and as depicted in FIGS. 8 and 10A, the rack 40 may be defined as having two rack members 40*a* and 40*b* and at least one opening 45, which may have a variable diameter. As illustrated, the rack members 40*a* and 40*b* may be movably secured to one another with connectors 41. In one embodiment, the connectors 41 are spring-loaded bolt connectors. For example, and as illustrated in FIGS. 8 and 9 the rack member 40*b* is shown in a clamped or secured position (i.e., a second position). At this position a connector spring 41*b* is extended to draw the rack member 40*b* to a closed (i.e., clamped or secured) position around the container 14. FIGS. 9A and 11 illustrate the rack 40 into an unclamped position (i.e., open or receiving or first position). At this time, the rack member 40*b* is urged open as the connector spring 41*b* is compressed as a result of a bolt head 41*a* making contact with a front cross support 32*a* of the shuttle assembly 15. Thus, when the rack 40 is in a first position (i.e., forward or receiving position), the containers 14 may be easily loaded (FIG. 9A) or unloaded (FIG. 11E).

One or more container support members 43 (e.g., two opposing support members) for supporting the containers (e.g., support rods) may be connected to the shuttle 22 with one or more support member brackets 29 and corresponding shuttle brackets 27. In one embodiment, the invention provides two opposing support member brackets 29. Each support member 43 may extend between the two support member brackets 29.

FIGS. 3, 9, 9A, and 10A depict the rack 40 in various positions. FIG. 9A depicts the rack 40 in a first position configured to receive an empty container 14. FIGS. 9 and 10 depict the rack 40 in a second position configured to secure or grip the container 14 for movement along the travel path. As discussed, one of the rack members 40*a*, 40*b* are moveable between the first and second positions for receiving and securing the container 14. FIG. 10A depicts the rack 40 in a third position configured to grip and rotate the container 14 for cleaning at the wash station 20 while allowing for the cleaning fluid to circulate through the openings 45 about the container 14.

The shuttle assembly 15 may also include a drive assembly 28 for driving the shuttle 22 along the travel path. The shuttle assembly 15 defines a frame structure 23 upon which the drive assembly 28 may be mounted. The frame structure 23 includes one or more side rails 30 (e.g., plates or rails). Opposing cross supports 32*a* and 32*b* connect the side rails 30 one to the other. Likewise, a cross bumper 33 may extend between and connect the rear portions of the side rails 30, thereby providing additional cross support. A tongue 36 for providing additional support to the shuttle assembly 15 may be attached to each side rail 30.

The side rails 30 define a slot 31 that directs the shuttle 22 along the travel path. A shuttle bearing 44 connects the shuttle bracket 27, and therefore the shuttle 22, to the frame structure 23. The shuttle bearing 44 connects to the frame structure 23 by extending (i.e., fitting) into the slot 31.

At least one gear 34 (e.g., a Geneva gear) is connected to the shuttle 22 by a pivot shaft 35, which runs between the shuttle bearing 44 and the shuttle bracket 27. The gear 34 is positioned substantially adjacent to the shuttle 22 such that the gear 34 is between the frame structure 23 and the shuttle 22. Advantageously, the shuttle 22 may be rotatable about a pivot point (e.g., the center of the pivot shaft 35). The pivotal aspect of the shuttle 22 permits the apparatus 10 to adjust the position of the container 14 (e.g., for loading and washing). The gear 34 controls the rotational position of the shuttle 22 (and container 14) as it moves along the travel path in the enclosure 11. One or more cams 42 for directing the rotation of the gear 34 and shuttle 22 may extend along the interior of the frame structure 23 and along the travel path. In particular, openings or shaped portions of the gear 34 engage the cams 42 during movement of the shuttle 22 along the travel path so that the gear 34 rotates the shuttle 22 about the pivot point thereby facilitating the washing, filling, and sealing of the container 14.

Mounting brackets 24 for supporting the drive assembly 28 are secured to the frame structure 23 and to at least a portion of the enclosure 11. In one embodiment, the invention provides a mounting bracket 24 at each corner of the frame structure 23. The drive assembly 28 includes at least one drive assist 26 that may, in one embodiment, extend between two mounting brackets 24. It will be understood that the drive assist 26 may be any number of shapes or sizes that cooperate with (e.g., correspondingly engage) a drive sleeve 25. Stated differently, the drive assist 26 cooperates with the drive sleeve 25 to advance the shuttle 22 along the travel path. The drive sleeve 25 is connected to the mounting brackets 24 and to the shuttle 22 (e.g., with a drive bracket 37). The drive sleeve 25 carries the shuttle 22 along the travel path. In other words, the drive sleeve 25 is moveably connected to the drive assist 26 (i.e., the drive assist 26 extends into the drive sleeve 25) so that the drive sleeve 25 may travel along the length of the drive assist 26. In one embodiment, the drive assist 26 is substantially parallel to the travel path of the shuttle 22. In order to effect the movement of the shuttle 22, various types of power, such as pneumatic, hydraulic, and magnetic power, may be used to power the drive assembly 28.

The apparatus 10 further includes a number of stations for cleaning, filling, and sealing the container 14. As noted above, the enclosure 11 may house a load/unload station 18, a wash station 20, a fill station 21, and a seal station 16. The load/unload station 18 operates to permit the loading and unloading of the containers. The wash station 20 operates to clean the container 14 prior to filling and capping the container 14. The wash station 20 may include at least one dispensing device 47 (e.g., a sprayer) for dispensing a liquid cleaning solution (e.g., water and/or a sanitizer) against portions of the container 14 (i.e., inside and outside). In one embodiment, FIG. 11C depicts the wash station 20 having three dispensing devices 47. During the wash operation, the gear 34 engages the cams 42 as the shuttle 22 approaches the wash station 20 and pivots or rotates the shuttle 22 to drain the contents of the container 14. Upon completion of the wash operation, the shuttle 22 moves away from the wash station 20 and the gear 34 rotates the shuttle 22 and container 14 to the previous position (i.e., vertical in this embodiment). A water supply provides water to the wash station 20 and dispensing device 47. This water may be filtered and heated (e.g., to about 130° F.) before being dispensed to clean the container 14. Advantageously, the washing and sanitizing of existing bottles promotes environmental efficiency and reduces the costs of producing filled containers.

The fill station 21 operates to dispense a liquid (e.g., water or soda) into the container 14. As depicted in FIG. 11D, the fill station 21 includes at least one filling device 50 (e.g., a sprayer or nozzle) for dispensing liquid into the container 14. It will be understood that the filling device 50 may be fixed to the enclosure 11 or secured to a swing arm capable of moving the filling device 50 among various positions. A water supply may provide water to the fill station 21 and filling device 50. A filter (e.g., a sub-micron paper filter, such as a 0.2 micron filter, or a charcoal filter) may be attached to the water supply to remove impurities from the water. Moreover, an ultraviolet radiation source within the enclosure 11 may serve to kill any pathogens in the water. The fill station 21 may also include a device for inserting additives (e.g., vitamins, minerals, or flavourings) into the water or other liquid.

The liquid may be heated to above room temperature (e.g., about 130° F.) before being dispensed into the container 14. It will be understood that it is not necessary to heat the liquid. Once the liquid cools, a vacuum is created within the container, thereby promoting the use of a tamper-detection or tamper-proof seal such that tampering is readily evident to potential consumers.

Figure 12:
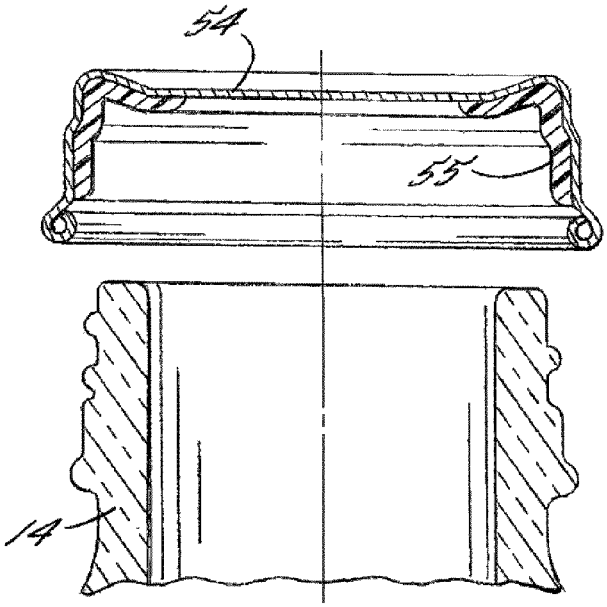
FIG. 12 is a partial cross-sectional view of an open container and a cap according to one aspect of the present invention.
Figure 13:
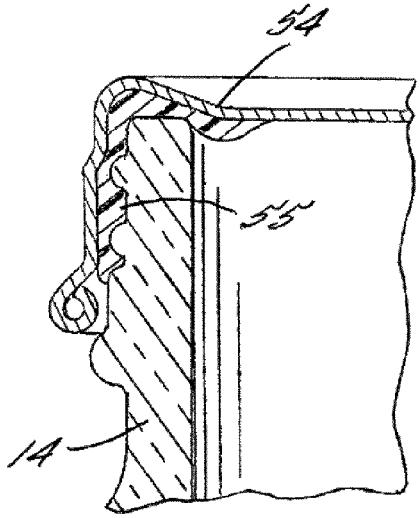
FIG. 13 is a partial cross-sectional view of a sealed container and cap according to one aspect of the present invention.

The seal station 16 operates to cap the container 14. FIG. 11E depicts an exemplary seal station 16 housed within enclosure 11 and including a cap sleeve 51, which feeds a cap release device 52. The cap release device 52 dispenses a cap 54 and positions the cap 54 over the opening of the container 14. The cap sleeve 51 and/or the cap release device 52 may include a heating element that heats the cap 54 in order to soften a material 55 (e.g., plastic) that forms at least a part of the cap 54. By way of example, the cap 54 may have a metallic exterior portion and a plastic or rubber interior portion. The seal station 16 may also include a pressure roller device 53, which assists the sealing of the heated cap 54 to the bottle threads and ensures that a tamper-detection seal is formed. FIG. 12 illustrates a heated cap 54 before it is placed on the container 14 and a seal is formed. FIG. 13 illustrates a cap 54 after the heated material 55 conforms to the shape of the container 14 thus forming a seal.

The seal station 16 may further include one or more dispensing devices for cleaning the caps before they are placed on a container. In this regard, the dispensing device may spray water (e.g., heated water) and/or a sanitizer onto the caps.

In another embodiment, the apparatus 10 may include a storage station within the enclosure 11 for storing containers 14 after the containers 14 are washed, filled, and capped. The storage station may include a device capable of removing the containers 14 from the shuttle 22 and placing the containers 14 within the storage station.

Figure 14:
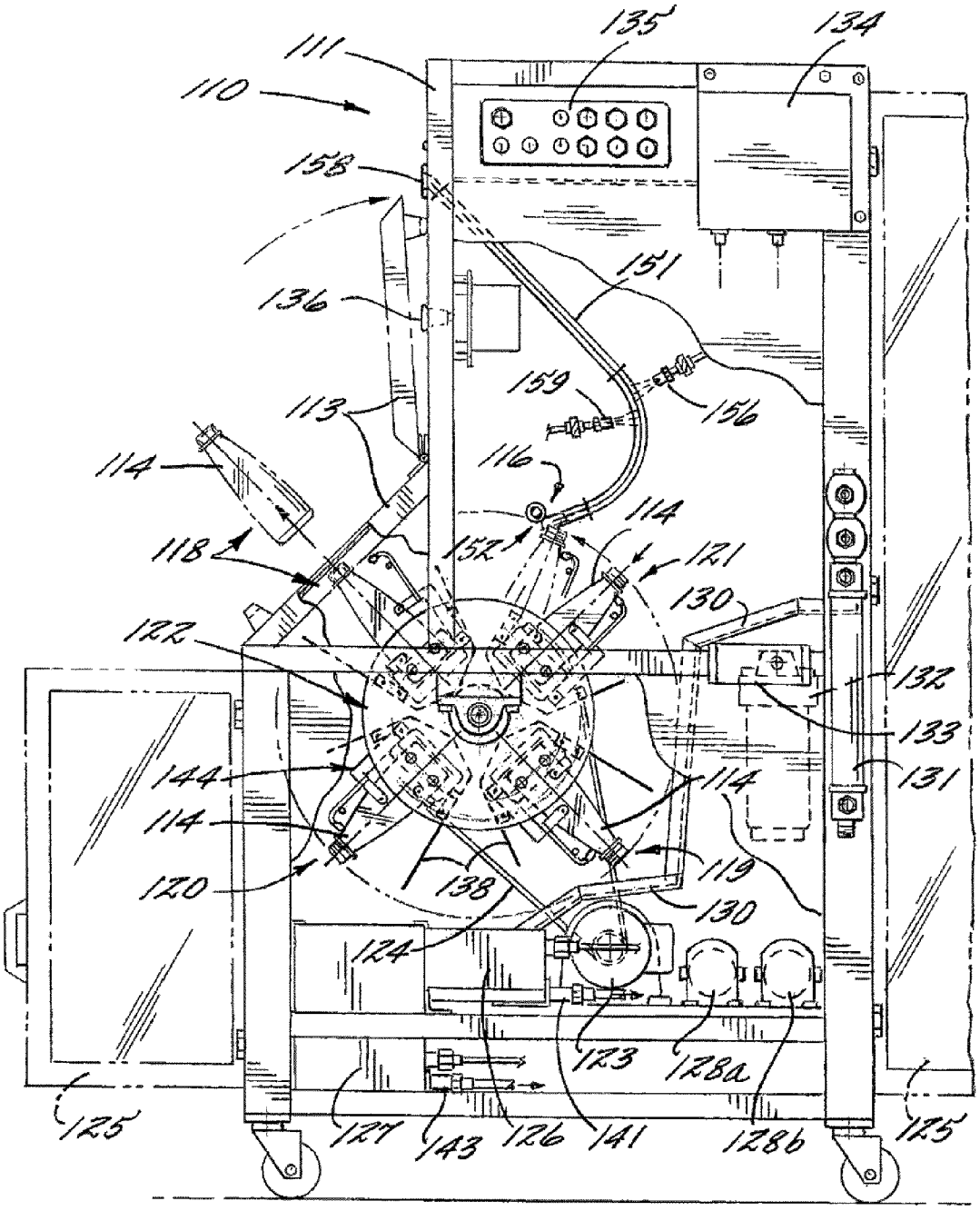
FIG. 14 is a cross-sectional side view of an apparatus cleaning, filling, and sealing a container according to another aspect of the present invention.
Figure 15:
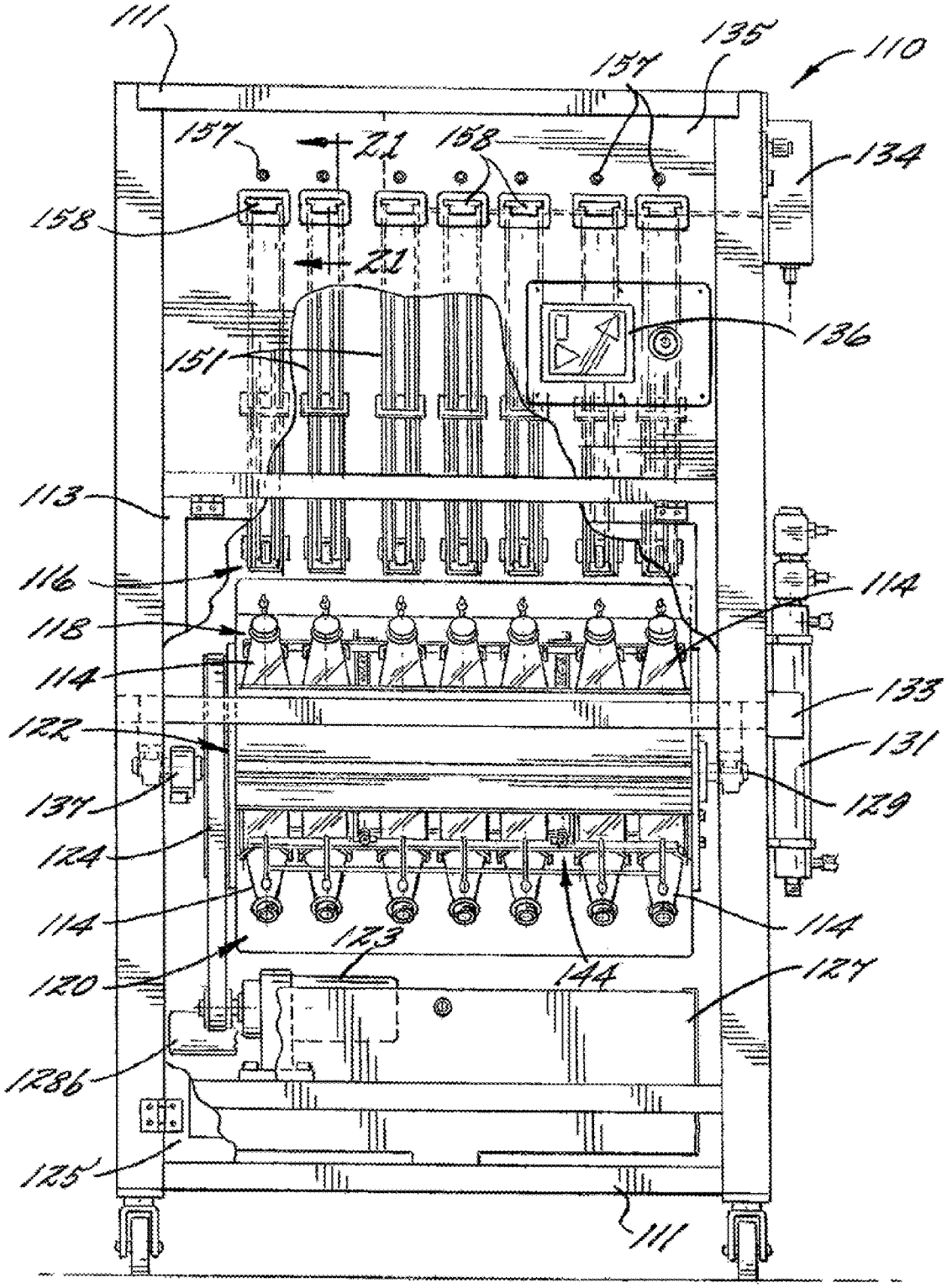
FIG. 15 is a cross-sectional front view of an apparatus for cleaning, filling, and sealing a container according to another aspect of the present invention.
Figure 16:
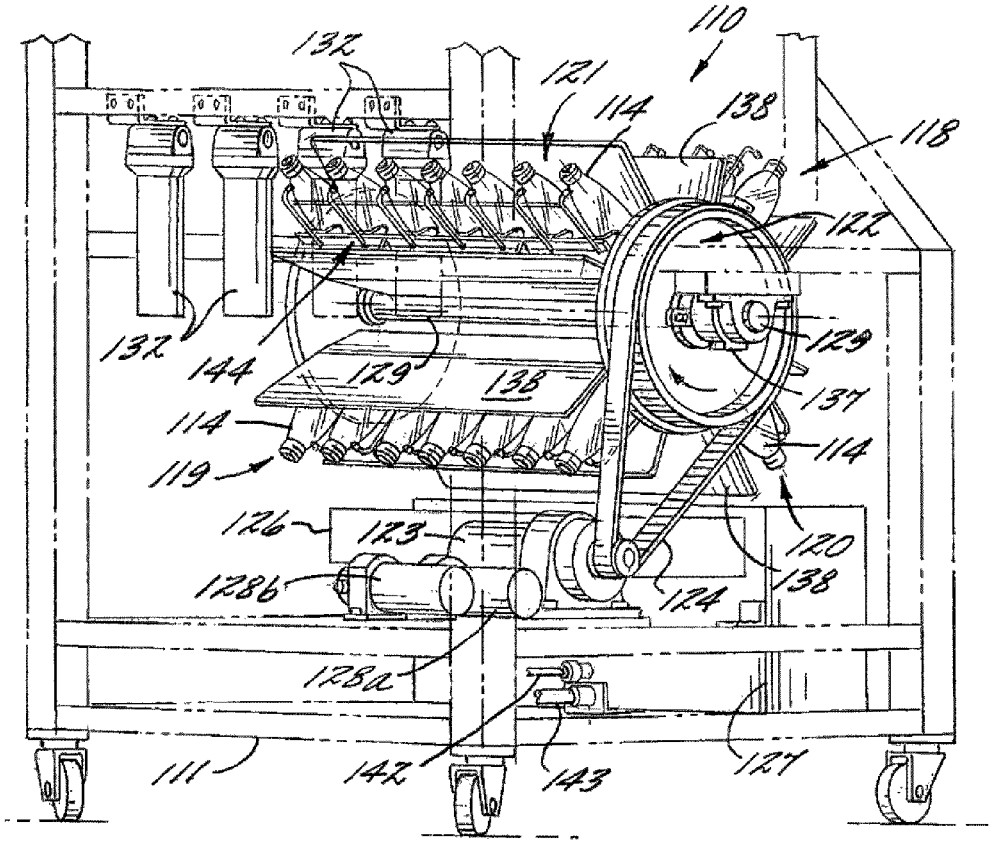
FIG. 16 is a perspective view of an apparatus for cleaning, filling, and sealing a container according to another aspect of the present invention.

FIGS. 14-16 depict an alternative apparatus 110 for filling a container 114. As described above, the container 114 may be any suitable container capable of holding a liquid. The apparatus 110 includes an enclosure 111 and a rotary assembly 122 for receiving one or more containers 114. In this regard, one or more (e.g., 4) bottle racks 144 may be secured to the rotary assembly 122. Moreover, one or more splash-guards 138 may be positioned adjacent to each bottle rack 144.

The enclosure 111 has at least one opening for receiving at least one container 114. For, example, the enclosure 111 may include a rotary assembly door 113. In one embodiment, the enclosure 111 may also include an opening (e.g., an access door 125) for providing access to, among other things, a wash station 120.

A drive motor 123 is connected to the rotary assembly 122 with a drive belt 124. The drive motor 123 and drive belt 124 define a drive assembly that drives the rotation of the rotary assembly 122. In one embodiment, the apparatus may employ a direct drive motor positioned along the rotary axis of the assembly 122 wherein the direct drive motor is attached directly to the shaft 129 of the rotary assembly 122. Advantageously, this configuration minimizes space required for the apparatus 110 and eliminates a gear and belt 124.

In operation, the rotary assembly 122 rotates about an axis so that one or more containers 114 secured to the rotary assembly 122 (e.g., secured to one or more bottle racks 144) advance along a travel path, which facilitates the cleaning, filling, and sealing of each container 114. For example, the rotary assembly 122 may rotate so that the containers 114 travel between a load/unload station 118, a wash station 120, a rinse station 119, a fill station 121, and a seal station 116. As set forth above, it will be understood that the term "cleaning" refers to the act of washing (i.e., to cleanse by or as if by the action of a liquid), rinsing (i.e., to cleanse by flushing with a liquid) and/or sanitizing (i.e., to make sanitary by cleaning) a container. Thus, action conducted at the wash station 120 may include rinsing and/or sanitizing with water or other liquid, and the action conducted at the rinse station 119 may include washing with water.

Figure 19:
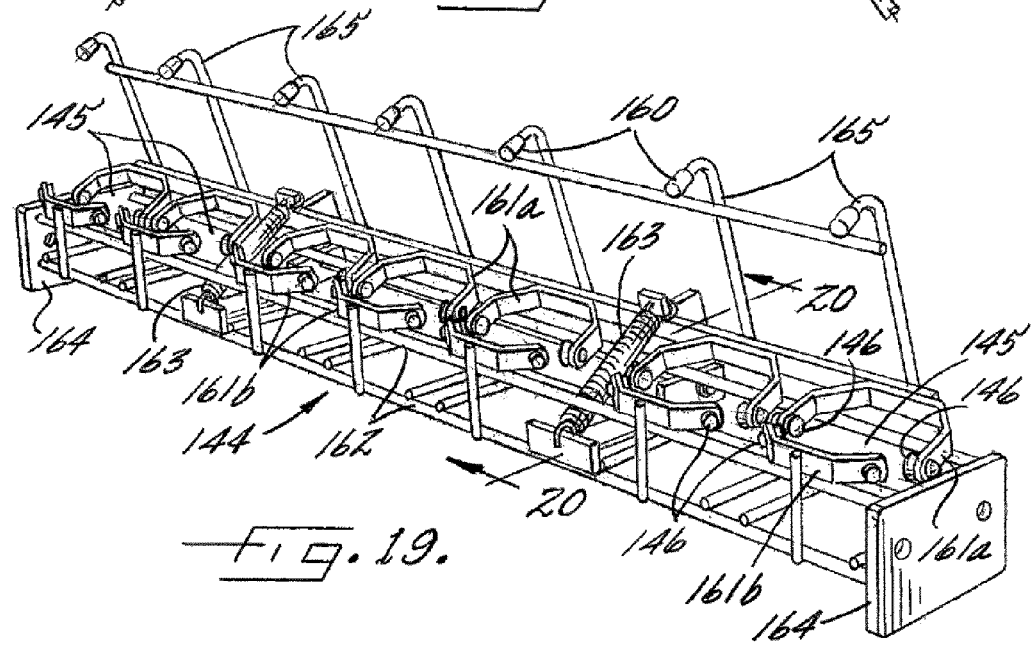
FIG. 19 is a perspective view of a bottle rack according to another aspect of the present invention.
Figure 20:
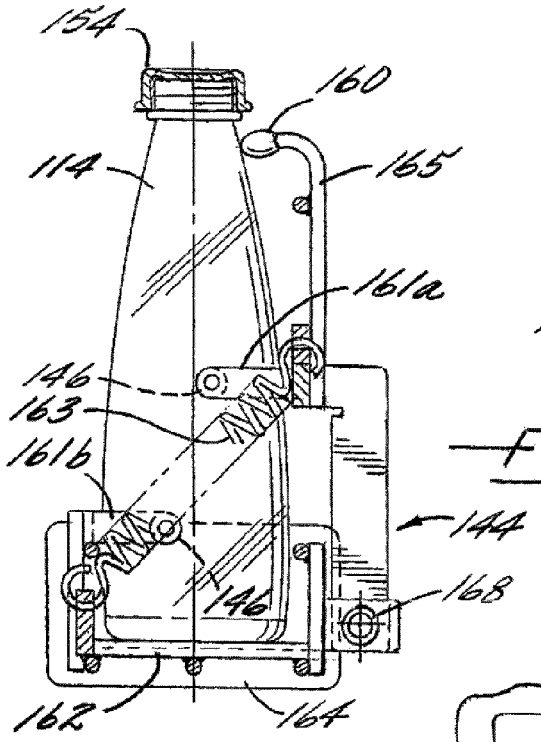
FIG. 20 is a cross-sectional side view of a bottle rack taken along line 20-20 of FIG. 19 according to another aspect of the present invention.

As noted, one or more bottle racks 144 may be secured to the rotary assembly 122. In this respect, FIGS. 19-20 depict an exemplary bottle rack 144 in more detail. The bottle rack 144 includes a frame structure 162 and opposing mounting brackets 164 for supporting the rack. The brackets 164 are connected to the frame structure 162. A bottle engager 165 may be attached to the frame structure 162 with a rotatable hinge 168. One or more springs 163 may be connected between the bottle engager 165 and the frame structure 162. The one or more springs 163 ensure that the bottle engager 165 is in a closed position, thus securing one or more (e.g., seven) containers 114 to the bottle rack 144. A cam 167, which may be attached to the enclosure 111, may be used to place the bottle engager 165 in an open position by overcoming the force from the spring 163. In this regard and as depicted in FIG. 18, the cam 167 is positioned to place the bottle engager 165 in an open position when the bottle rack 144 is positioned at the load/unload station 118, thereby allowing the containers 114 to be placed in (or removed from) the bottle rack 144.

One or more rack members 161*a* and 161*b* may be secured to the frame structure 162 and/or the bottle engager 165. The rack members 161*a* and 162*b* form one or more openings 145 for receiving a container 114. One or more grips 146 and 160 may be attached to the rack members 161*a* and 162*b* and/or to the bottle engager 165 to further facilitate securing one or more containers 114 to the bottle rack 144.

Figure 18:
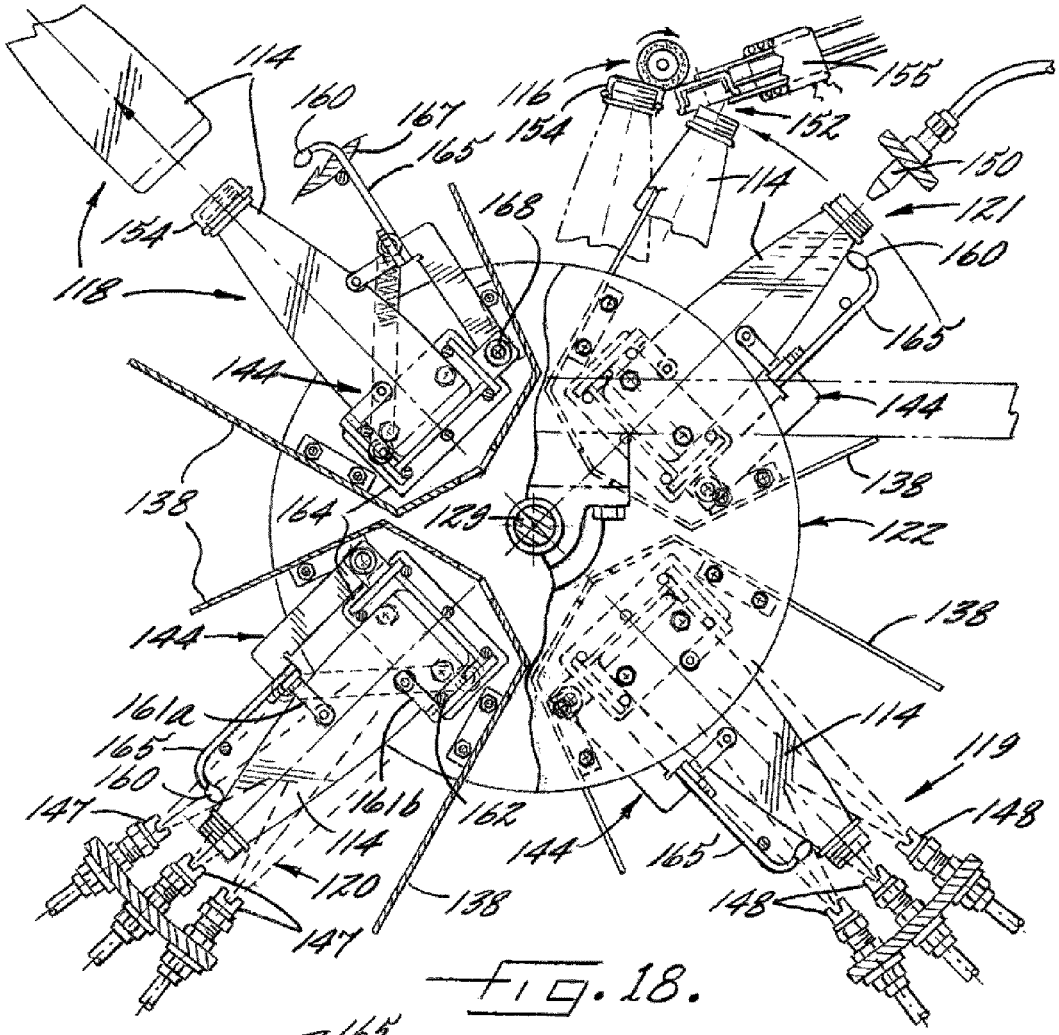
FIG. 18 is a cross-sectional side view of a rotary assembly according to another aspect of the present invention.

FIG. 18 depicts various stations for cleaning, filling, and sealing the containers 114. In particular, the enclosure 111 may include a load/unload station 118, a wash station 120, a rinse station 119, a fill station 121, and a seal station 116.

The load/unload station 118 operates to permit the loading and unloading of the containers 114. After the containers 114 are placed in the bottle rack 144, the rotary assembly 122 is rotated (e.g., approximately 90° to bring the containers 114 to the wash station 120. The wash station 120 operates to clean the container 114 prior to filling and capping the container 114. The wash station 120 may include at least one (e.g., three) dispensing device 147 (e.g., a sprayer) for dispensing a liquid cleaning solution (e.g., water and/or a sanitizer) against portions of the container 114 (i.e., inside and outside). In one embodiment, anolyte (i.e., a positively charged oxidizing agent capable of killing a broad spectrum of pathogens) may be used as a sanitizer. After the containers 114 are washed, the rotary assembly 122 may be rotated (e.g., about 90° to bring the containers 114 to the rinse station 119. The rinse station 119, which may include one or more dispensing devices 148, ensures that the sanitizing or cleaning solution sprayed at the wash station 120 is rinsed away before the container 114 is filled at the fill station 121. A water supply provides water to the wash station 120 and to the rinse station 119. At the wash station 120, water containing a sanitizing agent (e.g., anolyte) is strained (e.g., with a mesh 127*a*) to remove any foreign debris (e.g., paper) and reused during its active life cycle as discussed below.

Figure 17:
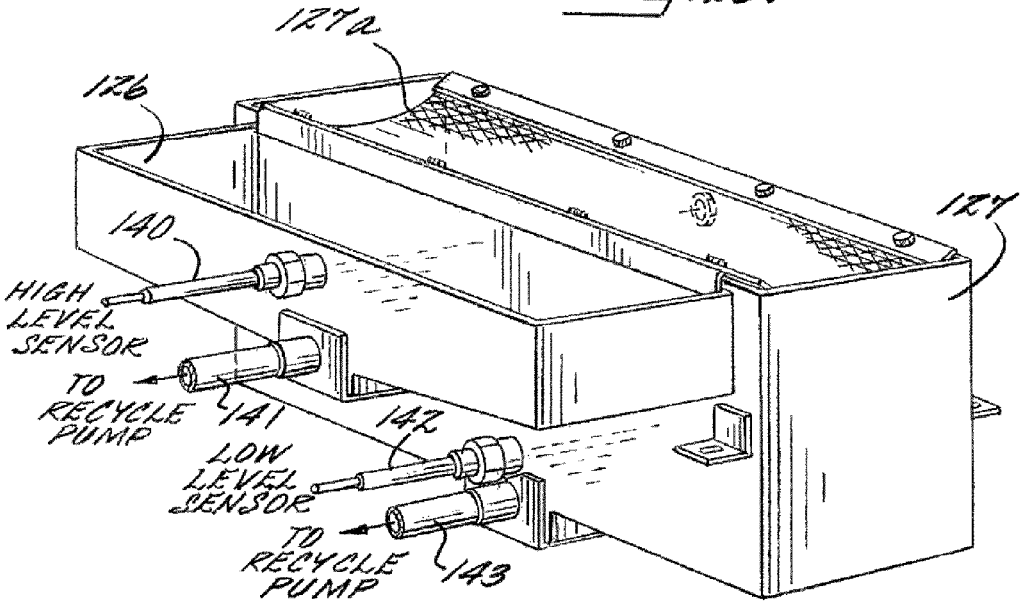
FIG. 17 is a perspective view of a wash fluid recycling tank and a rinse fluid recycling tank according to another aspect of the present invention.

Excess fluid from the wash station 120 and the rinse station 119 may be collected in a wash fluid recycling tank 127 and a rinse fluid recycling tank 126 depicted in FIG. 17. In this regard, a drip pan 130 helps to collect excess fluid (e.g., water) from the rinse station 119 and deliver it to the rinse fluid recycling tank 126. The recycling tanks 126 and 127 are connected to one or more (e.g., two) pumps 128*a* and 128*b* with connectors 141 and 143. Once the amount of fluid collected in the recycling tanks 126 and 127 reaches a certain level (e.g., as detected by a high level sensor 140 and a low level sensor 142), it is pumped through a number of filters and reused at the wash station 120 and the rinse station 119, thereby replacing an external source of water.

After the containers 114 are cleaned and rinsed, the containers 114 are brought (e.g., by the rotation of the rotary assembly 122) to the fill station 121. The fill station 121 dispenses a liquid (e.g., water or soda) into the container 114. As depicted in FIG. 18, the fill station 121 includes at least one filling device 150 (e.g., a sprayer or nozzle) for dispensing liquid into the containers 114. It will be understood that the filling device 150 may be fixed to the enclosure 111 or secured to a swing arm capable of moving the filling device 150 among various positions. A water supply (e.g., a municipal water source) may provide water to the fill station 121 and filling device 150. A pressure sensor 133 measures the pressure of the water supply. In the event that an unacceptable amount of pressure is detected (i.e., low or high pressure) the pressure sensor 133 will relay a signal to a controller 135 (e.g., a programmable logic controller (PLC)) which will cease all operations in the apparatus.

One or more filters 132 (e.g., a sub-micron paper filter, a charcoal filter, or an ultraviolet filter) may be attached to the water supply to remove impurities from the water before it is used to fill the containers 114. In an exemplary embodiment, the water supply is attached to a 20 micron sediment filter, a 5 micron charcoal filter, a 1 micron charcoal filter, and a 0.5 micron charcoal filter. Moreover, an ultraviolet radiation source 131 attached to the enclosure 111 may be used to kill any pathogens in the water. The fill station 121 may also include a device for inserting additives (e.g., vitamins, minerals, or flavourings) into the water or other liquid. Advantageously, the water from the wash station and the water from the fill station are kept separate by one or more splash guards 138 positioned within the enclosure 111. The dispensers used to deliver the water to the container are configured to accurately deliver water into the container opening. In the event of overfill, excess water will drop to the bottom of the apparatus and drain therefrom.

The liquid may be heated to above room temperature (e.g., about 130° F.) at a water heater 134 before being dispensed into the containers 114. Once the liquid cools, a vacuum is created within the container, thereby promoting the use of a tamper-detection or tamper-proof seal so that tampering is readily evident to potential consumers. That said it will be understood that heating the liquid is not necessary with the use of an appropriate cap capable of sealing without heating.

Figure 23:
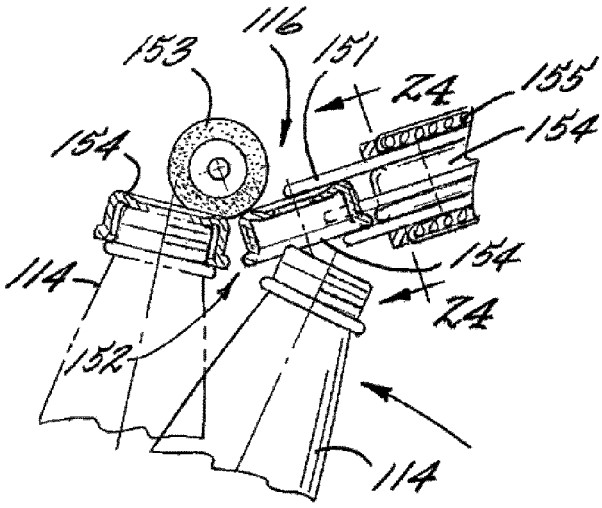
FIG. 23 depicts the step of sealing a container in accordance with another aspect of the present invention.
Figure 24:
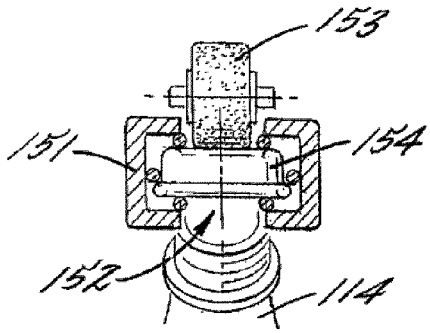
FIG. 24 depicts a cross sectional view of a cap release device taken along line 24-24 of FIG. 23 according to another aspect of the present invention.

After the containers 114 are filled, they are brought to the seal station 116. FIGS. 23-24 depict the seal station 116 in more detail. The seal station 116 includes at least one cap sleeve 151, which holds a plurality (e.g., about 350) of caps 154 and feeds one or more cap release devices 152. Each cap release device 152 dispenses a cap 154 and positions the cap 154 over the opening of the container 114. The cap sleeve 151 and/or the cap release device 152 may include a heating element 155 that heats the cap 154 in order to soften a material that forms at least a part of the cap 154 (e.g., plastisol which is a suspension of synthetic resin particles convertible by heat into solid plastic). By way of example, the cap 154 may have a metallic exterior portion and a plastic or rubber interior portion. The seal station 116 may also include a pressure roller device 153, which assists the sealing of the heated cap 154 to the bottle threads and ensures that a tamper-detection seal is formed.

The seal station 116 may further include one or more dispensing devices (e.g., a cap sanitizing fluid dispenser 156) for cleaning the caps before they are placed on a container 114. In this regard, the dispensing device may spray water (e.g., heated water) and/or a sanitizer onto the caps 154. Thereafter, the caps 154 may be sprayed with clean filtered water from a cap cleaning dispenser 159 to remove any sanitizing fluid, which then drains to the bottom of the apparatus along with water dispensed at the wash station.

Figure 21:
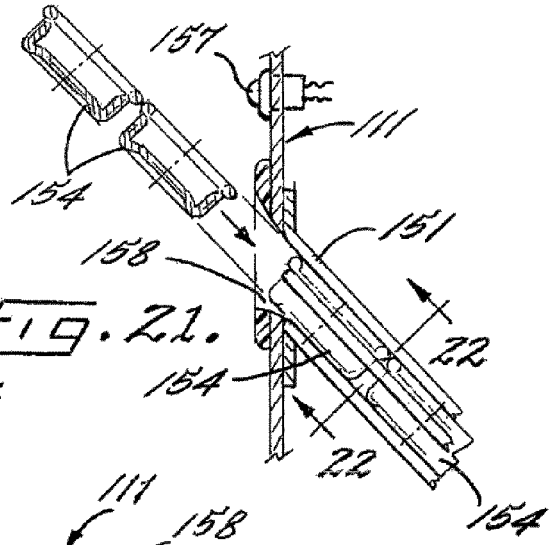
FIG. 21 is a cross-sectional side view of a cap sleeve taken along line 21-21 of FIG. 15 according to another aspect of the present invention.
Figure 22:
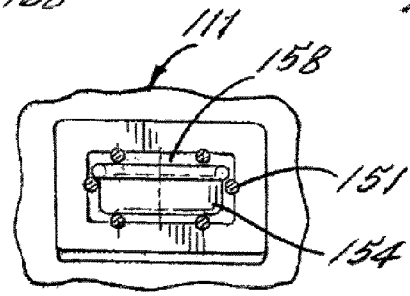
FIG. 22 is a cross-sectional view of a cap sleeve taken along line 22-22 of FIG. 21 according to another aspect of the present invention.

FIG. 21 depicts the caps 154 being loaded into the one or more cap sleeves 151 through an opening 158. An indicator 157 (e.g., a light emitting diode or LED) may be located adjacent to each opening 158. The indicator 157 alerts a user when the cap sleeve 151 is empty or nearly empty of caps 154.

The apparatus 110 may include a controller 135 (e.g., a central processing unit or CPU) for controlling the operation of the apparatus. In particular, the controller 135 controls the rotation of the rotary assembly 122 and the operation of the various stations within the enclosure 111. An encoder 137 is attached to the rotary assembly 122 and is able to detect the rotation of the rotary assembly and communicate this information to the controller 135. In this regard, the controller 135 helps to ensure that the cleaning and filling of the containers takes place as part of a series of timed cycles. For example, the rotation of the rotary assembly 122 is paused for a period (e.g., for about one to three minutes) to allow the wash station 120, the rinse station 119, and the fill station 121 to perform their above described operations. Moreover, this time period allows filled and sealed containers 114 to be removed from the apparatus 110 and unfilled containers 114 to be inserted at the load/unload station 118. Afterwards, the rotary assembly 122 is rotated (e.g., 90° to bring the containers 114 to the next station. The above described cycles continue so that each container 114 is brought to each station within the enclosure 111. Although the rotary assembly 122 pauses at the wash station 120, the rinse station 119, the fill station 121, and the load/unload station 118, the rotary assembly 122 need not pause at the seal station 116. Rather, the seal station 116 places a cap 154 on each container 114 as it rotates past the seal station 116.

A control panel 136 allows a user to control the operation of the apparatus 110. For example, a user may select to run the cycles described above. Alternatively, a user may select to run a self-cleaning cycle of the apparatus 110. For example, a series of spray nozzles may be positioned about the inside of the enclosure 111 to dispense a sanitizing solution that will sanitize the internal components of the apparatus 110 as necessary.

In another embodiment, the entire enclosure 111 could be configured with wheels or skids such that the entire apparatus is transportable.

In another aspect, the present invention embraces a method for consecutively washing, filling, and sealing at least one container in an enclosed housing. FIGS. 11-11E and 18 depicts various steps of the method for consecutively washing, filling, and sealing at least one container in an enclosed housing.

As depicted in FIG. 1, a container is provided and thereafter secured to the shuttle. After the container is secured in the load/unload station, the shuttle is advanced to a wash station. As depicted in FIGS. 11B and 11C the shuttle may be rotated to drain any remaining liquid or articles from the container. In one embodiment, after rotation, if any, the container is washed. In another embodiment, the container may be washing while the container is being rotated. Washing may involve spraying the interior and exterior of the container with a liquid cleaning solution.

Alternatively and as depicted in FIG. 18, a container may be secured to a rotary assembly 122. This rotary assembly rotates about an axis to bring the container from the load/unload station to a wash station. After the container is washed, the rotary assembly may again be rotated to bring the container to a rinse station.

After the container is washed and/or rinsed, the container is brought to a fill station (e.g., by rotating and advancing the shuttle or by rotating the rotary assembly). The fill station dispenses a liquid (e.g., water or soda) into the container.

After the container is filled, the container is brought to a seal station. At the seal station, a cap is placed on the container and the container is sealed. In one embodiment, sealing occurs once the heated portions of the cap cool and seal the container (e.g., from about two to seven seconds).

Finally, the container is brought back to load/unload station.

The steps of the present method may be conducted consecutively. In other words, after the step of providing one or more containers on one rack the initial containers advance to the various stations. That said, although a particular container advances consecutively through the various stations, after all racks are full of containers the various stations operate simultaneously.

The previous steps may be conducted along the travel path as described above. Moreover, the previous steps may take place as part of a timed cycle, which may take several or more minutes (e.g., 3 minutes) to complete.

In the drawings and specification, there have been disclosed typical embodiments on the invention and, although specific terms have been employed, they have been used in a generic and descriptive sense only and not for purposes of limitation, the scope of the invention being set forth in the following claims.

The invention claimed is:

1. An apparatus for filling a container, said apparatus comprising:

an enclosure having at least one opening for receiving at least one container;

a rotary assembly for receiving said at least one container, said rotary assembly housed by said enclosure and rotatable about an axis;

at least one rotatable engager for securing said at least one container, said engager secured to a frame structure of at least one rack of said rotary assembly for receiving and securing said at least one container; and one or more cams mounted to an interior surface of said enclosure, said one or more cams for moving said engager to an open position to facilitate the loading and unloading of said at least one container;

wherein said rotary assembly advances along a path of travel and facilitates the washing, filling, and sealing of said at least one container.

2. A filling apparatus according to claim 1 wherein said rotary assembly comprises:

a drive assembly for driving said rotary assembly, said drive assembly mounted to said enclosure.

3. A filling apparatus according to claim 1 wherein:

said at least one rack in a first position is configured to receive said at least one container; and said at least one rack in a second position is configured to secure said at least one container for movement along the travel path.

4. A filling apparatus according to claim 2 wherein said rack further comprises:

opposing mounting brackets for supporting said rack, said mounting brackets connected to said frame structure.

5. A filling apparatus according to claim 1 wherein said rotary assembly further comprises:

one or more rack members secured to the frame structure, said rack members forming one or more variable openings for receiving said at least one container.

6. A filling apparatus according to claim 1 further comprising:

a wash station for cleaning said at least one container, said wash station housed by said enclosure; and at least one dispensing device positioned substantially adjacent to said wash station.

7. A filling apparatus according to claim 6 further comprising:

a wash fluid recycling tank for collecting and recycling liquid dispensed at said wash station, said wash fluid recycling tank positioned below said wash station within said enclosure.

8. A filling apparatus according to claim 1 further comprising:

a rinse station for rinsing said at least one container, said rinse station housed by said enclosure; and at least one dispensing device positioned substantially adjacent to said rinse station.

9. A filling apparatus according to claim 8 further comprising:

a rinse fluid recycling tank for collecting and recycling liquid dispensed at said rinse station, said rinse fluid recycling tank positioned below said rinse station within said enclosure.

10. A filling apparatus according to claim 1 further comprising:

a fill station for dispensing liquid into said at least one container, said fill station housed by said enclosure; and at least one filling device positioned substantially adjacent to said fill station.

11. A filling apparatus according to claim 1 further comprising:

a seal station for capping said at least one container, said capping station housed by said enclosure; and at least one cap sleeve positioned substantially adjacent to said seal station.

12. A filling apparatus according to claim 9 further comprising:

at least one cap release device for dispensing at least one cap from said cap sleeve onto an opening of said at least one container.

* * * * *

UNITED STATES PATENT AND TRADEMARK OFFICE

CERTIFICATE OF CORRECTION

PATENT NO. : 8,356,461 B2
APPLICATION NO. : 12/618193
DATED : January 22, 2013
INVENTOR(S) : Daniel Pompei Cedrone It is certified that error appears in the above-identified patent and that said Letters Patent is hereby corrected as shown below:

In the Claims:

Column 12, Line 33, Claim 12 reads:

"A filling apparatus according to claim ~~9~~ further"

and should read:

"A filling apparatus according to claim 11 further"

Signed and Sealed this
Twenty-third Day of April, 2013

Teresa Stanek Rea
*Acting Director of the United States Patent and Trademark Office*